United States Patent [19]

Cope

[11] 4,373,446

[45] Feb. 15, 1983

[54] BEARING ADAPTER FOR RAILROAD TRUCKS HAVING STEERING ARMS

[75] Inventor: Geoffrey W. Cope, Williamsville, N.Y.

[73] Assignee: Dresser Industries, Inc., Dallas, Tex.

[21] Appl. No.: 172,895

[22] Filed: Jul. 28, 1980

[51] Int. Cl.[3] ..... B61F 3/08; B61F 5/30; B61F 5/38; B61F 5/50

[52] U.S. Cl. ..... 105/224.1; 105/168

[58] Field of Search ..... 105/224.1, 218 R, 165, 105/167, 168

[56] References Cited

U.S. PATENT DOCUMENTS

| | | | |
|---|---|---|---|
| 3,638,582 | 2/1972 | Beebe | 105/224.1 |
| 3,699,897 | 10/1972 | Sherrick | 105/224.1 |
| 4,111,131 | 9/1978 | Bullock | 105/224.1 |
| 4,131,069 | 12/1978 | List | 105/224.1 |
| 4,131,069 | 12/1978 | List | 105/224.1 |
| 4,274,339 | 6/1981 | Cope | 105/168 |

*Primary Examiner*—Richard A. Bertsch

*Attorney, Agent, or Firm*—John N. Hazelwood; B. E. Deutsch

[57] ABSTRACT

A truck for a railway vehicle including wheelsets each comprising a pair of wheels with an axle rigidly joining the wheels. A bearing assembly is provided at each end of the axle. A side frame having a pedestal jaw at each end accommodates therebetween one of the bearing assemblies, with the bearing assembly including an adapter member. The truck further includes a steering assembly operatively connected to the bearing adapter and thereby to the wheelset for radially steering the truck. The adapter member includes a main body portion underlying the pedestal jaw of the side frame, and an extension section extending axially of the axle inward from the main body portion towards the center of the truck. The adapter member extension section includes an upwardly facing, generally planar surface underlying a steering arm of the steering assembly. The arm is connected to and supported by the surface. Two spaced buttress type ribs project upward from the surface to receive the steering arm therebetween.

5 Claims, 5 Drawing Figures

BEARING ADAPTER FOR RAILROAD TRUCKS HAVING STEERING ARMS

BACKGROUND OF THE INVENTION

This invention relates broadly to railway car rolling stock, and in particular relates to railway car trucks which are equipped to be radially self-steering.

Railway trucks that are radially self-steering have proven to considerably reduce the lateral force on the rail in curves and to greatly improve the stability of the lateral action in high speed tangent track operation. In one form of self-steering railroad truck, steering arms are connected to a member forming one element of the bearing assembly provided towards each end of an axle of the wheelset. Generally speaking, the steering arms have heretofore been attached to the bearing adapters of the bearing assembly.

Adapters are generally manufactured via a casting process requiring a significant amount of machining preparatory to connecting a steering arm to the adapter. For example, an end of the adapters must be machined for providing a suitable surface for interfacing with the steering arms which have been similarly machined. Heretofore, two relatively high strength bolts have been used to secure the adapters to the steering arms. The use of such bolts has required drilling and tapping of both the steering arms and adapters. The foregoing are relatively expensive operations as they require relatively large fixtures to accommodate the hardware in order to maintain the required accuracy of the resulting assembly. The drilling and tapping processes are subject to close tolerances thereby further increasing the cost of assembly. Further, the bolts must be torqued extremely tight to insure the integrity of the connection between the adapter member and the steering arm. The stress induced in the bolts due to such torquing dictates that the bolts be of a high quality without flaws to avoid material fatigue during operation of the truck. Such bolts are inordinately expensive and do not assure against failure.

SUMMARY OF THE INVENTION

Accordingly, it is an object of this invention to improve railway trucks of the type having a steering assembly with steering arms.

It is a further object of this invention to accurately and effectively connect the steering arms to the bearing assemblies of a railway truck.

It is another object of this invention to secure the adapter element of a bearing assembly and a steering arm an an assembly, without subjecting the securing means to a major portion of the operating loads acting on the assembly.

It is another object of this invention to weld the adapter element to a steering arm in a manner that the weld is loaded in compression.

It is another object of this invention to reduce the cost of manufacturing a self-steering railroad truck.

These and other objects of the invention are attained in a truck for a railway vehicle having a set of wheels and an axle rigidly joining said wheels, a bearing assembly at each end of said axle, a first side frame having pedestal jaws accommodating therebetween two of said bearing assemblies, a second side frame having pedestal jaws accommodating therebetween the other bearing assemblies and a pair of steering arms for radially steering said truck operatively connected to the axles. The bearing assemblies each include an adapter member having a main body portion underlying said side frame pedestal jaw and an extension section extending axially inward therefrom toward the center of the truck parallel to the axle. The extension section has an upwardly facing generally planar surface underlying the steering arm, with spaced buttress type ribs upstanding therefrom to lateraly locate and support the steering arms for attachment by welding or other means to the planar surface. The top surface of the main body portion of the adapter is planar and provided with upstanding projections to interlock with the lower plate of a resilient yaw pad sandwiched between the adapter and the pedestal jaw roof.

DESCRIPTION OF THE PREFERRED EMBODIMENT

Figure 1:
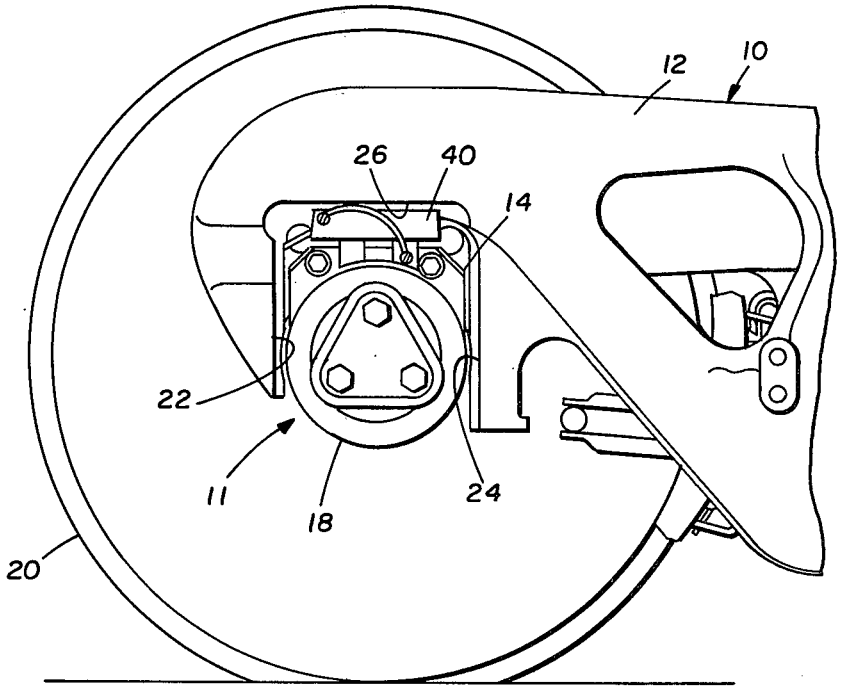
FIG. 1 is a side elevation view of the railway truck of the present invention.

Referring now to the drawings, there is disclosed a preferred embodiment of the present invention. In referring to the various figures of the drawings, like numerals shall refer to like parts.

The present invention relates to railroad trucks of the type having self-steering capability. In particular, such self-steering railroad trucks generally include some means such as steering arms for radially steering the wheelsets, and thereby the railroad truck, with respect to the rails on which the truck is rolling. Although the present invention is specifically illustrated as being used with the self-steering railroad truck of the type illustrated in U.S. Pat. No. 4,131,069 issued on Dec. 26, 1978, in the name of Harold A. List, it should be understood that the invention is equally suitable for use with other forms of railway trucks having steering arms for radially steering the truck.

Referring particularly in FIG. 1, there is shown a railway truck 10 comprising an axle extending transversely of the truck. A pair of wheels 20, only one of which is shown, are rigidly mounted on axle 11 adjacent ends thereof for rotation therewith. An anti-friction bearing 18, such as a roller bearing, is suitably carried on the axle usually outwardly of wheels 20. Side frames 12, only one of which is shown, are disposed longitudinally of the truck usually outwardly of wheels 20 and have downwardly depending pedestal jaws 22 and 24 spaced fore and aft of bearing 18. Pedestal jaws 22 and 24 define therebetween a load carrying surface of roof 26 positioned directly above bearing 18. Steering arms 28 (shown in FIGS. 3–5) are operatively connected to axles 11 through means to be more fully described hereinafter for radially steering the railroad truck.

Figure 2:
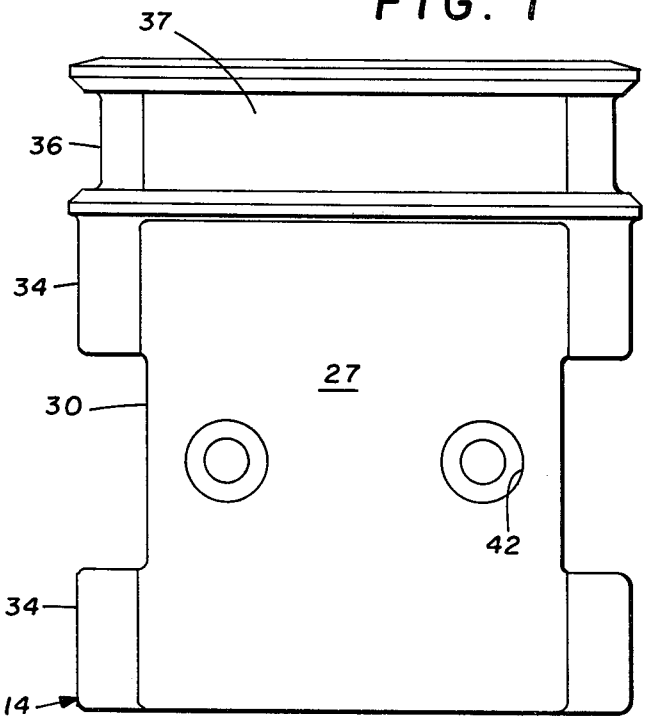
FIG. 2 is an enlarged, partial fragmentary plan view of an adapter showing details of the invention.

A bearing adapter member generally indicated at 14 is received in overlying relation to and carried upon the top surface of bearing 18 and forms with the bearing an assembly. Preferably, as shown in FIGS. 1 and 2, adapter 14 comprises a main body portion 30 underlying roof 26 of side frame 12. The adapter has a flat upper load receiving surface 27 for mating with a flat load carrying surface of a resilient yaw pad 40 sandwiched between pedestal jaws roof 26 and adapter 14. Further, the adapter includes a lower concave surface 32 (see FIG. 4) extending transversely thereof which is adapted to fit over and be received on a top surface of bearing 18. Lugs 34 (shown in FIG. 2) having portions spaced on opposite sides of the main body of adapter 14, define an opening for straddling stop lugs (not shown) formed on the pedestal jaws to provide limited clearance for lateral movement of the axle and wheels relative to side frame 12.

Figure 3:
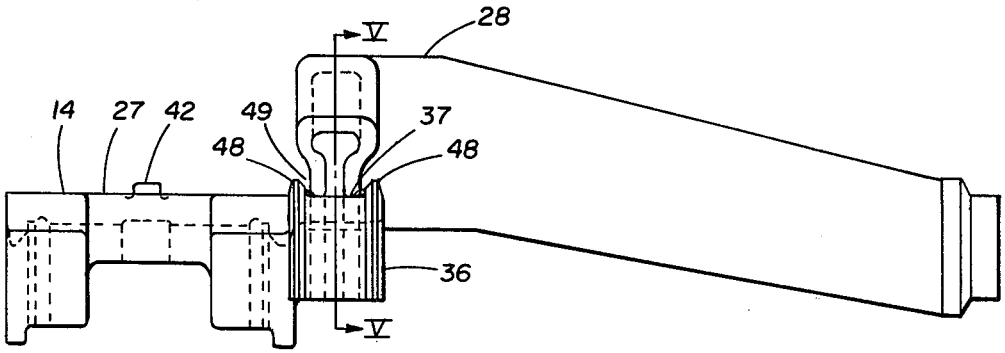
FIG. 3 is an end view of the assembly illustrated in FIG. 2.
Figure 4:
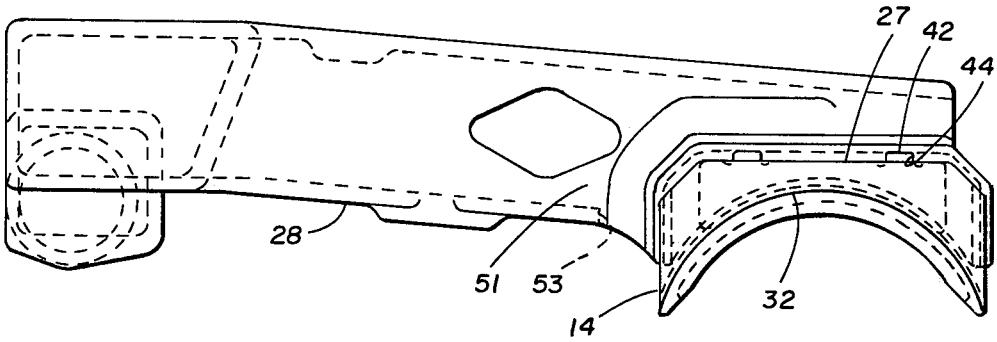
FIG. 4 is a side elevation of the assembly illustrated in FIGS. 2 and 3.

Pad 40 may be of the type sold by the Lord Corporation of Erie, Pennsylvania and disclosed in U.S. Pat. Nos. 3,274,955 and 3,699,897 but is preferably a modified version of simplified construction. Pad 40 applies resilient control over the longitudinal movement of the wheel and axle assembly (wheelset) relative to side frame 12 and elastically balances the steering forces acting on the wheelsets of truck 10. Preferably, as shown in FIGS. 2, 3 and 4, at least one spud 42 extends vertically upward from surface 27 of adapter 14 and is received in a complementary opening 44 formed in the lower surface of pad 40. The combination of spud and complementary opening provides means for connecting the pad to the main body of the adapter.

Figure 5:
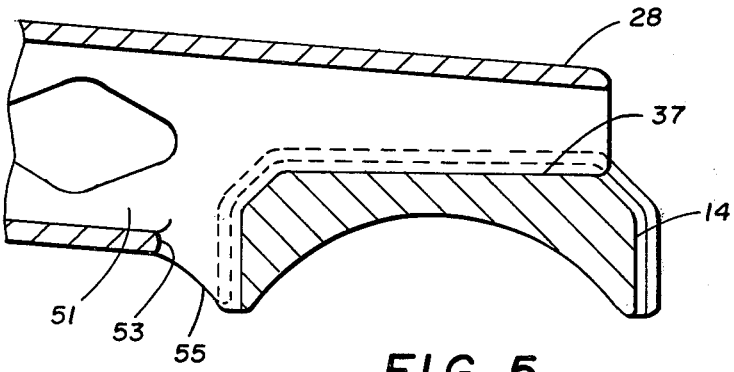
FIG. 5 is a cross sectional view taken along line V—V of FIG. 3.

Extending axially inwards from the main body portion of adapter 14 is an extension section 36. The extension section of the adapter extends axially towards the center of the truck parallel to axle 11 and has upwardly facing generally planar surface 37 underlying steering arm 28. Surface 37 has upstanding, spaced buttress type ribs 48 extending therefrom. The space between ribs 48 is slightly greater than the width of the steering arm to accommodate weld material 49 used to connect the steering arm to the ribs and thus to the adapter element. As shown in FIGS. 4, and 5, the steering arm is supported by the upwardly facing surface of the extension section of the adapter element and laterally by the upstanding buttress type ribs. To eliminate a stress concentration area side walls 51 of steering arm 28 adjacent to adapter 14 are extended downward and lower wall 53 is terminated at the tangent point of the resulting radius. Buttress ribs 48 withstand the major portion of the loads generated on the steering arm-adapter element assembly during operation of truck 10. Weld material 49 is not subject to such loads, thereby decreasing the possibility of the weld failing due to excessive operating loads thereon. Further the weld is maintained in compression between the confronting surfaces of ribs 48 and steering arm 28 to further assure the integrity of the weld during operation of the truck.

Heretofore, with radial self-steering railway trucks, the steering arms have been bolted to the bearing adapters for operative connection to the axles. This arrangement requires extensive and accurate machining of the bearing adapter and steering arm at the respective surfaces defining the interface therebetween. Further, drilling of both the bearing adapter and steering arms has been required to accommodate the bolts employed for connecting these parts. The machining adds considerably to the cost of manufacturing the railway truck steering mechanism and in addition requires extreme accuracy to assure a square configuration when assembled to minimize the stress placed on the bolts.

By providing the bearing adapter with an extension section 36 such as disclosed herein, defining a support surface 37, having lateral locating buttress ribs 48 for the overlying steering arms, the manufacturing costs of radial steering can be reduced considerably. In particular, only minor grinding is required at the steering arm-adapter interface to provide a clean surface for accommodating weld material securing the adapter to the steering arm. Although it has been suggested in the past that the bearing adapters may be integrally formed with the steering arms, or attached thereto by welding, no one prior to the present invention had conceived a relatively easy, yet effective method for achieving the desired end result using a welding process or procedure that results in, at worst, minimal distortion of the steering arms.

While a preferred embodiment of the present invention has been described and illustrated, the invention should not be limited thereto, but may be otherwise embodied within the scope of the following claims.

The embodiments of the invention in which an exclusive property or privilege is claimed are defined as follows:

1. In a truck for a railway vehicle, a set of wheels and an axle rigidly joining said wheels, bearing assembly at each end of said axle, a first side frame having pedestal jaws accommodating therebetween one of said bearing assemblies, a second side frame having pedestal jaws accommodating the other bearing therebetween, said bearing assemblies each including a bearing adapter member and a steering arm for radially steering said truck operatively connected to said axle wherein said adapter member includes a main body portion underlying the roof of said pedestal jaws of said side frame and an extension section extending axially inward from said main body portion toward the center of said truck parallel to said axle and having an upwardly facing generally planar surface underlying said steering arm, and means maintained in compression for connecting said steering arm to said surface whereby the arm is supported on the surface.

2. In a truck in accordance with claim 1 wherein said pedestal jaws of said side frame include a downwardly facing surface spaced from an upwardly facing surface of said main body portion of said adapter member, and an elastomeric pad sandwiched between said surfaces, with the upwardly facing surface of said adapter member body portion including at least one vertically extending spud for interfitting within a complementary opening formed in the surface of said elastomeric pad positioned thereabove for interlocking said pad to said adapter surface.

3. In a truck in accordance with claim 1 or 2 wherein said steering arm is welded to said support surface of said extension section of said adapter member.

4. In a truck in accordance with claim 1 or 2 wherein a pair of spaced ribs extend upwardly from the planar surface of said extension section, with said steering arm being located between said ribs and laterally supported thereby.

5. In a truck in accordance with the claim 4 wherein the width of said steering arm is less than the space between said ribs, with weld material filling said space and being maintained in compression between the confronting surfaces of said ribs and steering arm.

* * * * *